US006877516B2

(12) United States Patent
Cagigas

(10) Patent No.: US 6,877,516 B2
(45) Date of Patent: Apr. 12, 2005

(54) APPARATUS AND METHOD FOR PROCESSING WINNOWERS AT A CIGARETTE MAKER

(76) Inventor: Johnny K. Cagigas, 2600 Weaver Rd., Macon, GA (US) 31202

( * ) Notice: Subject to any disclaimer, the term of this patent is extended or adjusted under 35 U.S.C. 154(b) by 0 days.

(21) Appl. No.: 10/265,870

(22) Filed: Oct. 7, 2002

(65) Prior Publication Data

US 2004/0261806 A1 Dec. 30, 2004

(51) Int. Cl.[7] ..... A24C 5/39
(52) U.S. Cl. ..... 131/110; 131/108; 131/131
(58) Field of Search ..... 131/108, 110, 131/290, 311, 312, 313, 319, 320, 322

(56) References Cited

U.S. PATENT DOCUMENTS 3,204,641 A 9/1965 Jones
3,219,042 A 11/1965 Molins
4,195,646 A * 4/1980 Kite ..... 131/312
4,566,470 A * 1/1986 Brackmann ..... 131/312
4,567,903 A 2/1986 Brackmann et al.
4,672,982 A 6/1987 Vigg
5,165,426 A 11/1992 Klammer et al.
5,234,007 A * 8/1993 Holmes et al. ..... 131/96
5,564,444 A 10/1996 Naylor
5,722,431 A 3/1998 Metzner et al.
6,394,098 B1 5/2002 Cunningham

* cited by examiner

*Primary Examiner*—Dionne A. Walls
(74) *Attorney, Agent, or Firm*—Middleton & Reutlinger

(57) ABSTRACT

Size reduction equipment is added at the feed end of a cigarette maker to take separated winnowers and other overages from a tobacco feed to the maker, cut or shred the overages to appropriate size and reintroduce the cut or shred overages into the lamina stream from a tobacco feed hopper for the cigarette maker. The winnowers may be pneumatically or mechanically conveyed back into the feed stream in the cigarette maker.

3 Claims, 2 Drawing Sheets

APPARATUS AND METHOD FOR PROCESSING WINNOWERS AT A CIGARETTE MAKER

BACKGROUND OF THE INVENTION

The present invention relates to processing winnowers at a cigarette maker and more particularly to the shredding of winnowers at a cigarette making machine and returning the shredded winnowers to the tobacco feed hopper for the cigarette maker.

In the manufacture of cigarettes, tobacco leaves are processed and cut into preselected particulate size for making into a tobacco rod for a cigarette. In the processing of the tobacco leaf, the lamina is separated from the stems and veins and the stems and veins are processed separately from the lamina for use in the manufacture of smoking articles including cigarettes. For example, it is common for the stems and veins to be cut into extremely small particle size and used in the manufacture of reconstituted tobacco sheets. Also, it is common for the stems to be processed for blending with lamina shreds at a cigarette making machine. One particular tobacco leaf processing operation is taught in U.S. Pat. No. 4,556,470 to Brackmann. In this particular processing operation the stem is separated from the lamina and the lamina is cut to a preselected size for a tobacco rod for a cigarette and the stem is shredded to a preselected particle size and blended with the lamina at a mixer and then fed to a cigarette making machine.

At the tobacco feed hopper for the cigarette making machine, a screening operation is provided to remove oversized particles from the feed stream going into the maker. These oversized particles are generally tobacco stems (winnowers), which are removed by gravity into a collection bin and returned to another facility within a tobacco processing plant for further use. In most operations the winnowers are crushed and ground up into very fine particles and used in the making of reconstituted tobacco sheets. U.S. Pat. No. 3,219,042 to Molins teaches that winnowers removed at the cigarette making machine are moistened to about 30% moisture, flattened by rolling and then cut into a desired number of cuts per inch and re-fed, along with lamina, to a cigarette making machine. U.S. Pat. No. 4,672,982 to Vigg teaches a process for converting tobacco winnowers into a usable form for a cigarette making machine which includes crushing the winnowers and passing the crushed winnowers through a plurality of sieving operations wherein the resulting small particles are then reintroduced into the tobacco feed stream for further processing.

SUMMARY OF THE INVENTION

It is an object of the present invention to provide a method for cutting winnowers at a cigarette maker to an appropriate size and reintroduce the cut winnowers into the lamina stream at the feed hopper to the cigarette maker.

It is another object of the present invention to reduce waste, handling, and transportation of winnowers which have been removed at a cigarette making machine.

More particularly, the present invention is directed to a method for processing winnowers at a tobacco feeder for a cigarette maker wherein the winnowers are separated from the lamina, shredded to a preselected particle size, and conveyed back to the feeder and mixed with the lamina in the feed hopper for the cigarette making machine.

These and other objects of the present invention may be readily understood by having reference to the following detailed description of a preferred embodiment of the present invention taken in conjunction with the accompanying drawings.

BRIEF DESCRIPTION OF THE DRAWINGS

Referring to the drawings.

DETAILED DESCRIPTION OF THE PREFERRED EMBODIMENT

Figure 1:
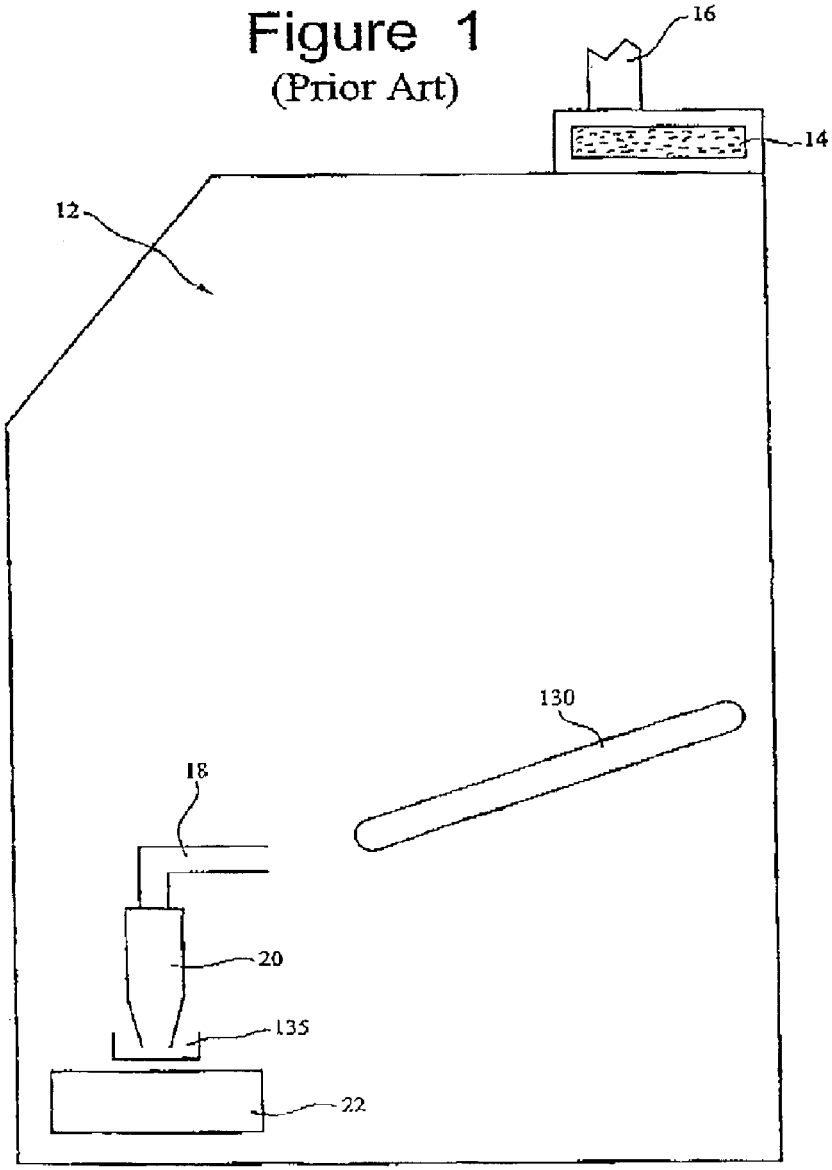
Figure 1 (Prior Art)
FIG. 1 is a schematic diagram of a prior art cigarette making machine and winnower collection box.

As shown in FIG. 1, a prior art cigarette making machine 12, such as a Hauni Protos 80, 90, or 100 series is provided with a tobacco feed hopper 14 for feeding tobacco lamina including a small percentage of oversized winnowers into the cigarette maker 12. Feed hopper 14 is in flow communication with a tobacco pneumatic feed line 16 which provides for the feed of tobacco to the cigarette maker. The cigarette maker 12 is provided with a screen downstream of the feed hopper 14 to remove the oversized particles including oversized winnowers which would not be acceptable in the manufacturing of cigarettes. These oversized particles are removed through air separation into a hopper 20 which includes winnowers as well as entrapped small pieces of lamina. A vacuum pick up line 18 is provided to remove the small entrapped lamina which separates from the heavier winnowers. The heavier winnowers are then gravity fed through the hopper 20 onto vibrating conveyor 135 and into a winnower collection box 22. The winnowers are manually removed and taken to another operating section for further processing, such as the manufacture of reconstituted tobacco sheets.

Figure 2:
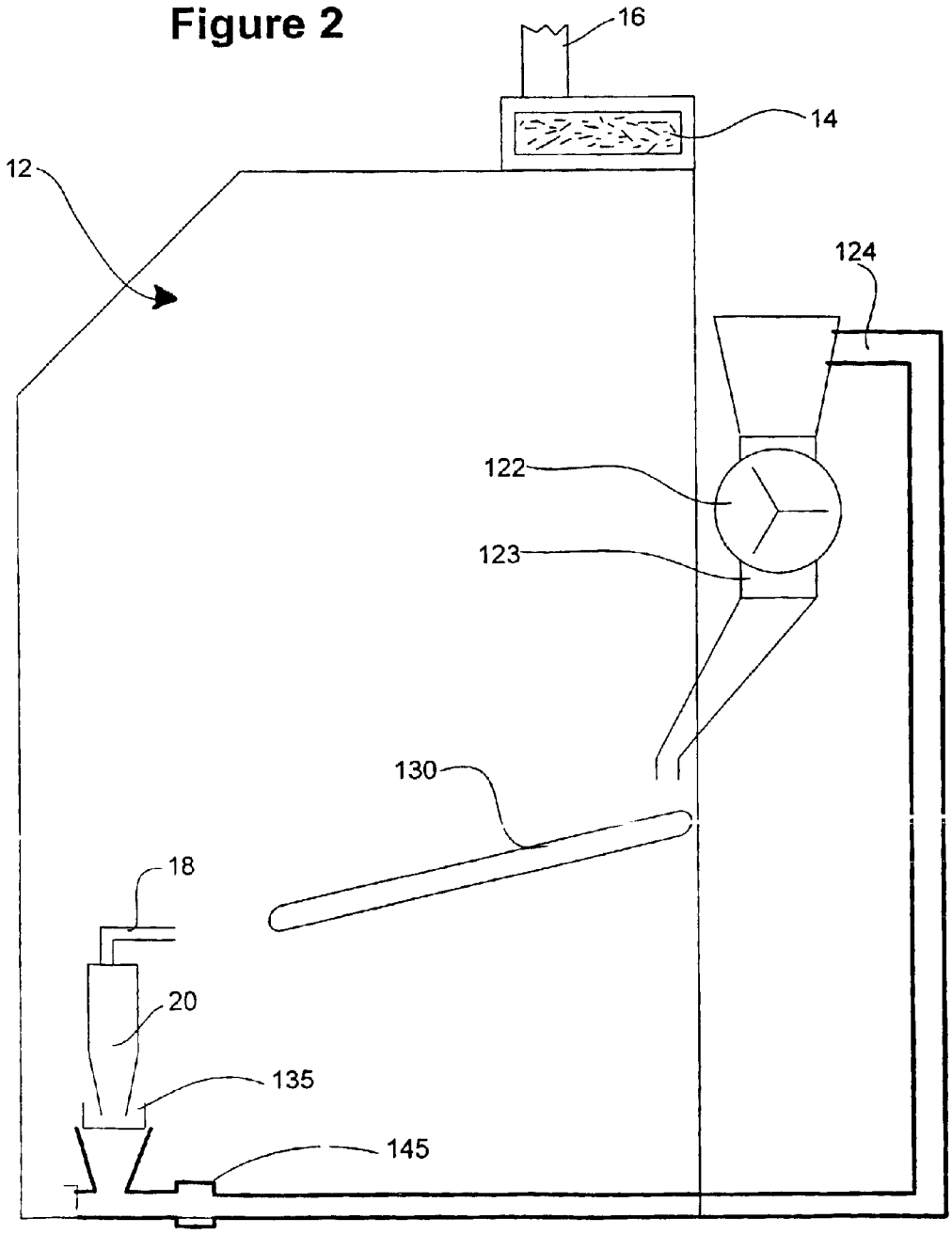
FIG. 2 is a schematic diagram of a preferred oversized winnower processing operation of the present invention.

In FIG. 2 is shown a modification of the feed end of the cigarette maker 12 wherein a chute has been added with a pneumatic transfer line 124 and compressed air transfer unit 145 to convey the winnowers to a shredder or cutter 122. A shredder 122, such as an SM100 cutting mill by Retsch GMBH & Co., is added downstream of the pneumatic transfer line 124 to receive the winnowers, thereby shredding the tobacco winnowers into a preselected particle size. The preferred shredder includes a rotary blade cutter with a screen 123 disposed in the outlet of the cutter 122. Usually the screen will be a 4 mm to 8 mm opening sieve. In the SM100 cutting mill a 6 mm sieve is preferred. The cut or shredded winnowers are gravity fed from the cutter 122 to a trim return conveyor 130 which is included within the cigarette maker 12. The trim return conveyor feeds the cut winnowers directly into the lamina stream separation below the tobacco feeder 14. It is realized that the winnowers and cut winnowers may be transferred by other means, such as a conveyor or the like. It is also realized that the cut winnowers may be fed into the tobacco lamina stream in other locations, such as the tobacco feed hopper 14 or the pneumatic feed line 16.

It will also be realized that various changes may be made to the specific embodiment shown and described without departing from the principals and spirit of the present invention.

What is claimed is:

1. A method for processing winnowers in a cigarette maker consisting essentially of the steps of:

separating winnowers and oversized particles from a cut lamina stream, upon discharge from a feeder, within a cigarette making machine; shredding said winnowers and oversized particles to a pre-selected particle size resulting in a shredded re-feed product, Feeding said re-feed product to a trim conveyor; and conveying said shredded re-feed product from said trim conveyor to the lamina stream, disposed below the tobacco feeder, within said cigarette making machine.

2. The method of claim 1, said shredding including a shredder having an inlet in flow communication with a tobacco stem and lamia separator, said shredder having a plurality of rotating cutting knives and a discharge outlet with a screen therein, said screen having a sieve size of from 4 mm to 8 mm openings.

3. The method of claim 2, said sieve size being 6 mm.

* * * * *